US007840338B2

(12) United States Patent
Paolacci

(10) Patent No.: US 7,840,338 B2
(45) Date of Patent: Nov. 23, 2010

(54) COMMUNICATION, MONITOR AND CONTROL APPARATUS, AND RELATED METHOD, FOR RAILWAY TRAFFIC

(75) Inventor: Marco Paolacci, Laterina (IT)

(73) Assignee: MP S.R.L., San Casciano Val di Pesa (FI) (IT)

( * ) Notice: Subject to any disclaimer, the term of this patent is extended or adjusted under 35 U.S.C. 154(b) by 425 days.

(21) Appl. No.: 11/908,662

(22) PCT Filed: Nov. 29, 2005

(86) PCT No.: PCT/IB2005/003588

§ 371 (c)(1),
(2), (4) Date: Sep. 14, 2007

(87) PCT Pub. No.: WO2006/097788

PCT Pub. Date: Sep. 21, 2006

(65) Prior Publication Data

US 2009/0234520 A1 Sep. 17, 2009

(30) Foreign Application Priority Data

Mar. 14, 2005 (IT) ..... PI2005A0028
Jul. 22, 2005 (IT) ..... PI2005A0082

(51) Int. Cl.
*G06G 7/70* (2006.01)

(52) U.S. Cl. ..... 701/117; 701/19; 701/20; 246/122 R; 246/124

(58) Field of Classification Search ..... 701/19, 701/20, 117, 118; 246/23, 122 R, 124, 176, 246/217; 340/425.1, 815.4
See application file for complete search history.

(56) References Cited

U.S. PATENT DOCUMENTS 4,209,749 A * 6/1980 Becker et al. ..... 455/524
2002/0091483 A1 7/2002 Douet
2003/0236598 A1 12/2003 Villarreal Antelo et al.
2005/0231381 A1* 10/2005 Pederson et al. ..... 340/815.45

OTHER PUBLICATIONS

Burns et al, "Safety and Productivity Improvement of Railroad Operations by Advanced Train Control System", Conference Proceedings, Apr. 25, 1989, pp. 33-38, IEEE/ASME, U.S.A.

* cited by examiner

*Primary Examiner*—Gertrude Arthur Jeanglaud
(74) *Attorney, Agent, or Firm*—Roylance, Abrams, Berdo and Goodman, LLP

(57) ABSTRACT

An apparatus, and related method, for monitoring and controlling the traffic of transport systems, such as railway vehicles, wherein the vehicles include device elements, such as satellite positioning systems, monitored by a series of centralized units to monitor and control adjacent areas. In case of anomalous traffic situations, the system and method provides proper alarm signals and signals for automatically putting into action the breaking systems of the vehicles. To do so, the devices can interface with breaking means and sensors placed along the railway paths and in the vehicles, and exchange positioning data or other kinds of data of various sensors, among vehicles running within a certain mutual distance and can further include a secured memory means for storing data, information and parameters.

14 Claims, 3 Drawing Sheets

COMMUNICATION, MONITOR AND CONTROL APPARATUS, AND RELATED METHOD, FOR RAILWAY TRAFFIC

TECHNICAL FIELD

The present invention refers to a communication, monitor and control apparatus for traffic, in particular for railway trains.

The invention also refers to a method for monitoring and controlling the traffic of railway transport means.

STATE OF THE ART

As known, at present the traffic of railway vehicles is mainly controlled and monitored by passive or partly passive railroad systems.

The above systems, unchanged since ages, allow, actually, monitoring very roughly the state of railway traffic and they do not perform effective automatic actions to control/stop the trains in case of danger.

It is to consider, for instance, that a train is assumed to be in a certain section of the railway just since it has been verified its departure, or its transit, from the station where said section of railway begins, and meanwhile, it has not been reported yet its arrival, or its transit, by the staff of the station placed at the end of said section of railway. In this way it is not possible to know the exact position of that train, nor, moreover, it is possible to know whether it is moving along that section of railway or it has stopped somewhere in.

Furthermore, as regards the actions which can be externally taken, by said passive systems, to make the train stop, these actions basically consist of preventing going through a specific section of railway by semaphoring appropriate messages at the ends of the section, whilst at definite points of the section, as, for instance, the points where two different tracks become a single track, were provided special devices, railway markers, dedicated to automatically stop the train when settled and specific conditions occur.

The above control and monitor systems seem to be deficient and inadequate in order to avoid potential dangerous situations, and, more importantly, they are not able to effectively operate when needed.

More recently new systems have been developed to determine the position of a train by the use of a positioning system, such as GPS, so that, for instance, prompt changes to the schedule can be carried out and improvement of the safety in the field can be obtained.

In U.S. Patent Publication No. 2003/0236598 of Villarreal Antelo et al., as an example, a traffic control and monitoring system is disclosed for a railroad whose objects are to allow rapid adjustments to operating parameters in reaction to changes in the system and to provide real-time feedback information to planners and dispatchers concerning the effect of any proposed change to planned schedules and/or operating conditions. To attain such objects, it provides a central computer located within a dispatch center controlling a traffic area, and onboard data processor and communication units mounted in every vehicle to be controlled. Each vehicle receives information from various radio and wire data channels, and receives, also, information about the current position from a GPS satellite.

It has to be noticed, however, that each vehicle is provided with a GPS receiver but it cannot transmit information via satellite. In fact, the position information is transmitted to the control center through a radio antenna, a wayside repeater and a fiber-optic network. Moreover, this solution does not foresee a direct communication between vehicles.

All this confirms that the disclosed system focuses on optimizing the train scheduling, but it does not consider the safety aspect as a primary matter.

In the train control systems developed by Rockwell International Corporation and described in the article of Burns et al., entitled "Safety and Productivity Improvement of Railroad Operations by Advanced Train Control Systems", Conference Proceedings, 25 Apr. 1989, we find, substantially the same communication means of U.S. Patent Publication No. 2003/0236598 to obtain the same objects of improving productivity and control in railroad systems.

In U.S. Patent Publication No. 2002/0091483 of Douet, finally, are faced the matters of surveying the position of trains in a railroad system and allowing the emission of warning signal in case of danger, in order to improve safety. Such objects are attained by the use of wayside transmitter/receiver units communicating via radio or cable connection with a central station and also communicating with devices placed onboard the vehicles. The onboard devices are provided with duplex transmitter/receiver units also apt to transmit and receive warning signals to and from other vehicles in a close area.

As known, duplex units are not efficient as they do not allow to transmit and receive at the same time. It follows then that a "direct" communication between two vehicles, in this case, can not be established in a secure and prompt way, and therefore, the safety in the field is not assured at full level.

So, it is worthwhile to develop solutions able to improve the safety level of the above public transport means, in particular trains, both from the point of view of what can be promptly performed in case of danger and from a preventive point of view and to collect data and information useful to reconstruct possible anomalous situations.

It is also worthwhile to be able to use, especially when it concerns railway traffic, services based upon the capability to connect to communication networks, which could be accessed as well by the travellers, and which could also get direct communications among the transport means and the controlling and managing centers or, even other institutions concerned.

SUMMARY OF THE INVENTION

Main object of the present invention is to propose an apparatus, and related method, to monitor in a complete and detailed manner the traffic of public transport means, in particular trains, and to automatically manage said transport means from centralized control stations.

Another object of the present invention is to propose an apparatus, and related method, apt to allow a direct exchange of data and information among public transport means, and in particular trains, in order to monitor their location and to automatically manage said transport means whenever specific dangerous situations occur.

Further object of the invention is to propose an apparatus for public transport means which is highly versatile as regards providing facilities and services for communication purpose, with a special care to safety, granting, in particular, the collection of data and information useful to reconstruct possible anomalous situations.

The aforesaid objects are attained through an apparatus for monitoring and controlling the traffic of public transport means, in particular trains, comprising centralized electronic and computerized units dedicated to control adjacent traffic areas having determined layout and extension, and also comprising devices mounted in every vehicle to be controlled, said devices being connected by satellite communication networks to said centralized units which receive, in continuous, moment after moment, vehicle identification data from each of said devices and, after they have processed said data according to special algorithms stored in said units, they display on specific visualization means distinctive data relating to the position and to other characteristics of every vehicle being in the monitored traffic area and they also provide, in case they detect anomalous traffic situations, to transmit proper alarm signals to said devices as well as signals for operating driving means of the vehicle, driving means that are interfaced with said devices.

The devices mounted in every monitored means of transport advantageously comprise transmitting and receiving means (via radio, telephone, or a different technology) apt, among other things, to directly connect the devices themselves to other devices mounted in vehicles which are within a certain mutual distance, said devices also comprising microcomputer units interfaced with sensors and devices mounted along the railroad as well with sensors and devices mounted in the trains, said microcomputer units being apt to activate alarm units and to control said driving means in order to cause the stop of the vehicle after automatically detected anomalous traffic situations.

The aforesaid devices mounted in every transport means provide for storing possible detected malfunctions as well as all data and parameters relating to the functionality of the train, said storing phase being executable in an encrypted as well as a not encrypted form. Memory means for storing said data and historic parameters are advantageously kept in a shock, high temperature, water and dust resistant box in order to preserve the data themselves for future analysis or inspections.

A method for monitoring and controlling the traffic of public transport means, in particular trains, consists of mounting in said transport means special devices apt to receive and transmit data and signals from and to satellites, spreading, in the area where the traffic has to be monitored, centralized electronic and computerized units dedicated to control adjacent traffic areas with a determined layout and extension, transmitting, by said devices to said centralized units, data pertaining to said transport means where said devices are mounted in, performing by said centralized units definite procedures for processing said data in a manner which is useful to:

- defining the position of the transport means which are in the monitored area,
- displaying in specific visualization means the geographical location of the transport means in the monitored area,
- detecting possible anomalous traffic situations according to stored traffic parameters,
- sending to the devices mounted in the vehicles involved in possible anomalous traffic situations, signals which activate alarm procedures and alarm means,
- sending to said devices, in case the anomalous situation persists, signals that run breaking means of the vehicles interfaced with said devices.

The method of the invention advantageously provides a direct transmission, via radio or different means, of data and information among devices mounted in vehicles which are within a certain mutual distance and provides as well for automatically activating alarm procedures and drive means of the trains in case that anomalous traffic situations occur, such as unexpected stops or impact alert. According to what above disclosed the advantages of the apparatus, and relating method, of the present invention are immediately clear, relating in particular to the full capability of monitoring and controlling the traffic that can be performed with said apparatus, and also relating to the possibility of an effective and prompt automatic action, if necessary, upon the monitored transport means.

BRIEF DESCRIPTION OF THE DRAWINGS

For a better understanding of the characteristics and the advantages of the present invention, it will now be described, by way of an example, an embodiment of the invention itself, with reference to the accompanying drawings, in which.

DESCRIPTION OF PREFERRED EMBODIMENTS

Figure 1:
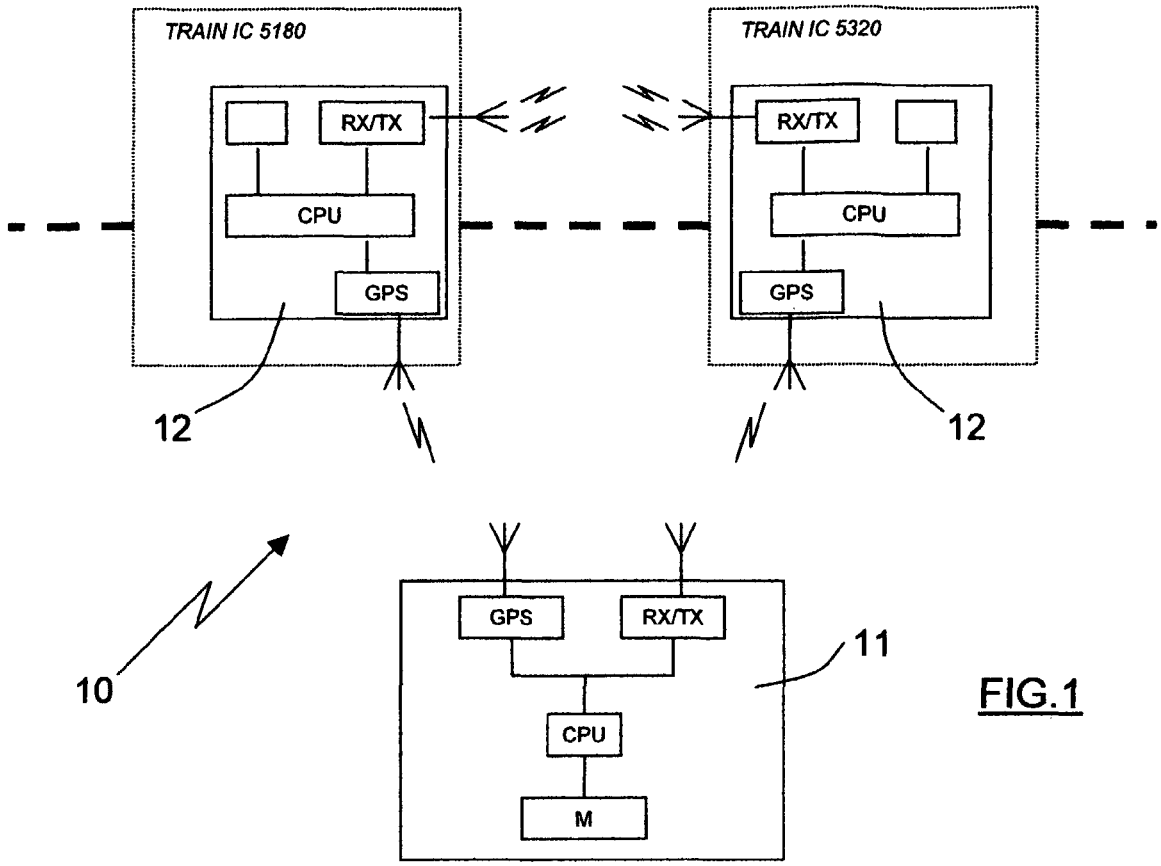
FIG. 1 schematically shows the mutual actions of the various components of an apparatus according to the present invention when referring to railway traffic.

With reference to FIG. 1, it is shown in a very schematic manner the layout of an apparatus, 10, according to the invention, as regards a specific traffic area; it is also schematically shown the mutual actions of the components of said apparatus.

The apparatus is composed, on every specific traffic area, of a unit, 11, intended to monitor and control said area, and devices, 12, mounted in every transport means to be monitored.

Both the centralized unit 11 and the peripheral devices 12 are equipped with via satellite transmission and reception means, via radio in this embodiment of the invention, operating with range and frequencies able to connect every device 12 which is in the monitored area with the centralized unit 11. The via radio transmission and reception means, in particular, are suitable to connect each other devices mounted in transport means whose mutual distance is within a certain range.

Figure 3:
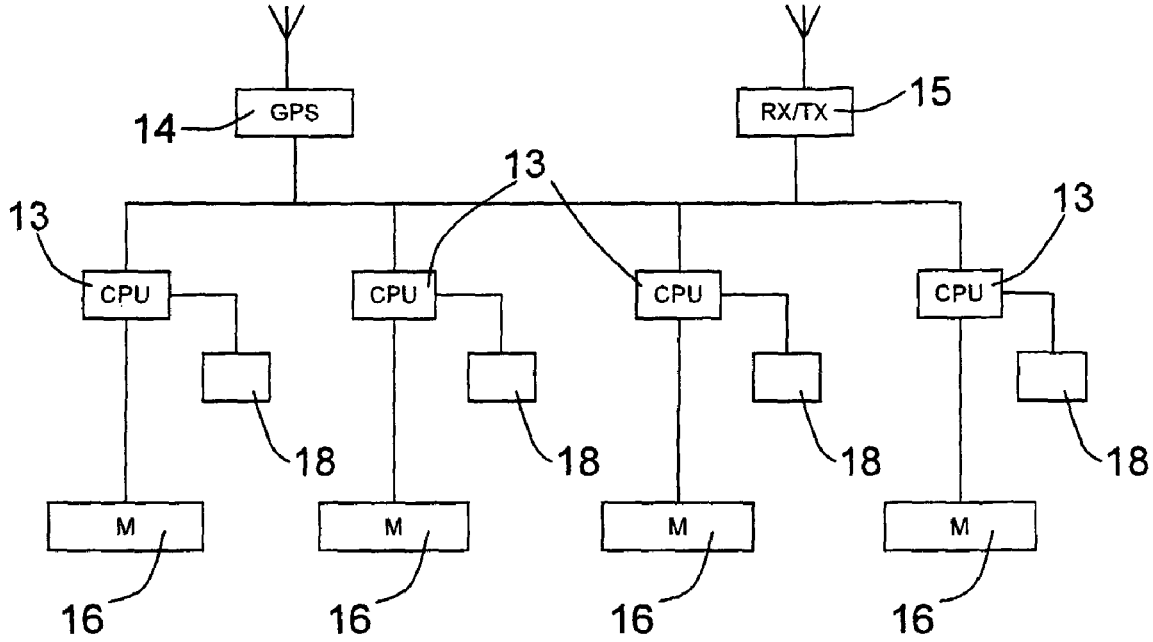
FIGS. 3 and 4 show two block diagrams referring to two different components of an apparatus of the invention.
Figure 4:
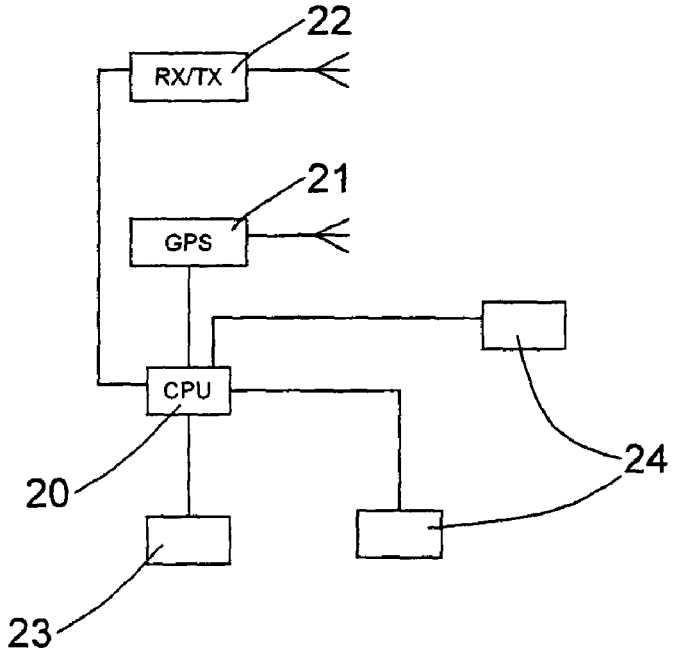

The centralized unit 11, as shown in detail in FIG. 3, is made of one or more processing units, 13, connected by a local network to a receiving/transmitting unit of the GPS type, 14, and to via radio receiving/transmitting units, 15. Said processing units 13 work according to specific procedures dedicated to control their area by using stored data and parameters regarding that particular area, such as timetables, average mileage time, trains identification codes, and others like these ones. The processing units 13 are connected to special display means, 16, and to devices, 18, dedicated to automatically emit signals and control commands after detecting determined or strange traffic situations, or after detecting dangerous situations referring to the practicability of the railway tracks, these dangerous situations being defined by the transmission of proper signals to the centralized units 11 from specific boards or authorities responsible for territory control, from an environmental point of view.

Figure 2:
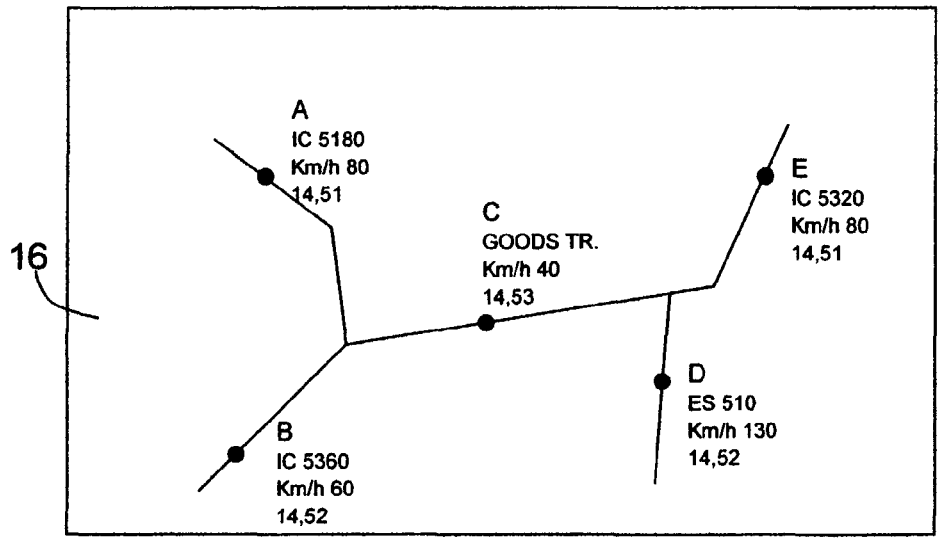
FIG. 2 shows an example of data and information visualization in display means mounted in some of the parts of FIG. 1.

In FIG. 2 is shown a possible visualization, on the display means 16, of data processed by the centralized unit 11; in particular, it can be seen, schematically drawn, the path of the railway comprised in the monitored area, and, for each branch of the displayed railway section, are shown the possible vehicles running in it, where, close to the spot indicating its position, are displayed some peculiar identification data of the vehicle itself, such as its number, its speed rate, the time of the last reached survey, or different data or information.

The peripheral devices, mounted in each means of transport to be monitored, comprise a microcomputer unit, 20, connected to via satellite GPS receiving/transmitting units, 21, and to via radio receiving/transmitting units, 22, comprised in the device. This last also comprises interfacing means, to connect with various sensors located along the vehicle in which the device 12 is mounted and interfacing means, 24, to connect with alarm devices installed in said vehicle as well as with drive means of the vehicle itself.

Figure 5:
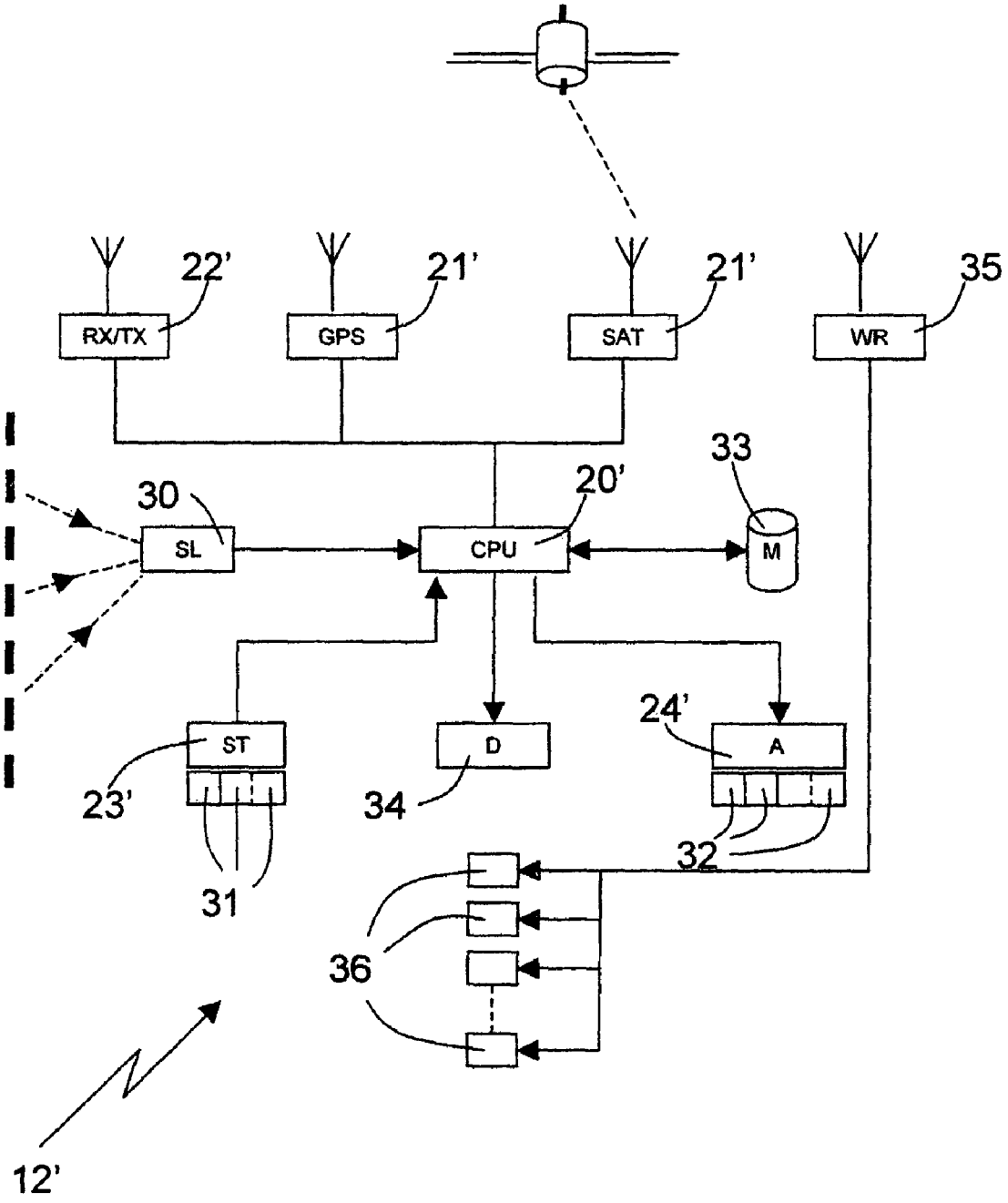
FIG. 5 shows a block diagram of a different embodiment of one of the components of the apparatus.

According to a preferred embodiment of the invention, the peripheral devices 12' comprise, according to what disclosed in the block diagram of FIG. 5:

- radio receiving/transmitting means (22');
- satellite and GPS receiving/transmitting means (21');
- at least one microcomputer unit (20');
- receiving means (30) to receive signals coming from devices and sensors spread along the railway;
- receiving means (23') to receive signals coming from sensors and devices (31) mounted in the means of transport;
- effecting means (24') to activate devices (32) placed on the means of transport;
- memory means (33) to store data, events, and history parameters useful to define how the means of transport has been working;
- communication means (34) dedicated to drive the transport means; and
- receiving/transmitting means (35) to communicate through wireless networks and communication means (36) intended to be used by the travellers.

Both the microcomputer unit, 20', and the relating interfacing means and the memory means for storing data and parameters are advantageously housed in a thick metallic box provided with adequate protections to resist to heavy mechanical stresses and thermal shocks, as, for instance, collisions up to about an acceleration of 3G, temperatures over 1000° C., and hydraulic pressures over 10 Atm, in order to preserve and keep safe the data in case of anomalous and unattended events, so allowing a later reconstruction of the event for prevention or investigation in general.

The radio receiving/transmitting means, 22', operate at dedicated frequencies and transmission channels, for example in the range of 450 Mhz, suitable to cover the areas where the monitored railway lays, in order to assure, in every point of the path of the transport means, the direct connection with the devices 12, 12', mounted in different vehicles which are within a certain distance range, so allowing a prompt exchange of information extremely useful in emergency situations, and also the connection with the devices spread along the railway path is assured, devices which are provided to automatically detect the working condition of the railway itself, as, for instance, the position of the switch points, the position of the semaphores, and the possible engaging of the level crossings, or other conditions and situations.

The receiving/transmitting means, 35, of the WR type, allow connection to wireless networks which, through proper land repeaters, work covering determined areas and branches of the railway network, so providing to the travellers some services and benefits.

To the microcomputer unit, 20', come, from through the interface means 30, data relating to signals emitted by sensors and devices installed along the railway branches, to automatically detect possible anomalies or to simply report the working conditions as above stated.

To the microcomputer unit, 20', also come, through the interface means 23', data relating to signals emitted by sensors and devices, 31, which are in the trains of the vehicle in which the device 12' is installed. Said sensors and devices comprise units for detecting the status of various mechanical members, such as breaking systems, train fastening means, or others.

Devices for detecting data or images, such as web-cam or similar, intended, for instance, for public surveillance by police corps, are connected to the communication means, 35, transmitting to wireless networks whereto are also connected terminals, 36, at disposal of the travellers in order to access services, such as POS, internet connection, or similar.

The microcomputer unit, 20', controls, through the interface means 24', devices, 32, which are in the vehicle, intended to effect, for example, breaking systems, alarm devices, fire extinguishing systems, or any other system provided to improve safety of the vehicle.

The method for monitoring and controlling traffic of public transport means, in particular railway trains, carried out through the above apparatus provides:

- transmitting in continuous mode, by said peripheral devices, 12, 12', to the centralized units, 11, peculiar identification data of the transport means where they are mounted in;
- executing, by said centralized units 11, specific computing procedures to elaborate said data in a way which is useful to:
  - determining the position of the transport means which are in the monitored area;
  - displaying on proper visualization means the geographical location of the transport means in the monitored traffic area;
  - detecting possible anomalous traffic situations comparing with traffic parameters stored in said centralized units;
  - sending to the devices, 12, 12', of the transport means concerned with possible anomalous traffic situations, signals activating procedures and alarm means; and
  - sending to said devices, 12, 12', in case the anomalous traffic situation persists, signals activating the breaking means of the vehicle interfaced to said devices.

In particular, the position of the transport means which are in the monitored traffic area is determined through a satellite positioning system.

The method of the invention also provides for a direct transmission, via radio or other means, data and information among devices, 12, 12', installed in vehicle which run within a certain distance range one from another and also provides for the automatic starting of alarm procedures and putting into action the breaking means of the vehicles, in case of detection of anomalous traffic situations, such as an unattended stop or a collision alert in single-track branches of the railway. Besides that, the centralized units 11 as well are able to start alarm procedures and to put into action the breaking means of the vehicles as a result of specific signals which come to the units themselves from specific boards or authorities responsible for territory control, from an environmental point of view.

It is also useful to note that when powering the devices 12, 12', which in a likely way occurs when the means of transport where they are installed begins working, data identifying the vehicle and the driver or drivers are required, and, after memorization of said data, the device 12, 12', performs a full check of the functionality of the sensors and activating means connected to it and which are controlled by the device itself, and, if there are any detected anomalies or malfunctioning of the main equipments and systems, a report is sent and the departure of the vehicle is interdicted; otherwise, the device permits the normal working of the means of transport, and transmits to the control centre of the area the relating identification data in order to allow localization and monitoring, according to the above disclosed system and method.

When the device 12, 12', is put out, it automatically transmits to the control centre of the area data relating to possible anomalies about sensors and activating means detected when the vehicle was running, in order, among the others, to improve both routine and special maintenance procedures of the companies which manage said vehicles.

The advantages arising with the use of the apparatus, and related method, of the present invention are still safe even in presence of modifications and changes to the layout of the apparatus and to the phases of the above disclosed method.

For instance, changes could affect the type and number of the centralized processing units of the various monitored traffic areas; these last, obviously may vary as regarding their extension and shape according to the traffic density of a certain area and to the efficiency of the control which can be exercised on that area. The means for transmitting data, information and signals may, as already said, be other than the via radio transmission means shown in the appended embodiments, and they may comprise, for example, mobile phone communication means, GSM, GPRS EDGE or other means.

The means for transmitting data, information and signals may, as already said, be other than the via radio transmission means shown in the appended embodiments, and they may comprise, for example, mobile phone communication means, GSM, GPRS EDGE or other means.

Other changes or modifications can be brought to the invention still remaining in the field of protection defined by the following claims.

The invention claimed is:

1. An apparatus for monitoring and controlling traffic of public transport means, in particular trains, comprising centralized electronic and computerized units (11) dedicated to control adjacent traffic areas having a determined layout and extension, and devices (12, 12') mounted in every vehicle to be controlled, characterized in that said devices (12, 12') comprise:

receiving/transmitting means configured to connect said devices (12, 12') to said centralized units (11), which continuously receive, at fixed time intervals, from each of said devices (12, 12'), identification data of the vehicle where devices (12, 12') are installed, process said data according to special algorithms stored in said centralized units (11), and, display on a visualization means (16) data relating to the position and to other characteristics of every vehicle in the monitored traffic area and provide, in case of detected anomalous traffic situations, proper alarm signals to said devices (12, 12') as well as signals for operating driving means of the vehicle, wherein said driving means are interfaced with said devices (12, 12');

at least one microcomputer unit (20, 20');

a GPS via satellite transmitting and receiving means (21, 21');

further transmitting and receiving means (22, 22'), wherein said further transmitting and receiving means (22, 22') are configured to directly connect each of the devices (12, 12') where said transmitting and receiving means (22, 22') are located, to similar devices (12, 12') mounted in other vehicles;

interface means (23, 23') to connect to sensors which are in the vehicle where said devices (12, 12') are mounted; and interface means (24, 24') to connect to alarm devices installed in said vehicle and to said driving means of the vehicle.

2. The apparatus (10) according to claim 1 characterized in that said further transmitting and receiving means (22, 22') are configured to directly connect each of the devices (12, 12') where said transmitting and receiving means (22, 22') are located, to similar devices (12, 12') mounted in vehicles which are running within a certain distance range.

3. The apparatus (10) according to claim 1 characterized in that said further transmitting and receiving means (22, 22') comprise radio receiving/transmitting means operating at dedicated frequencies and transmission channels configured to cover the areas of the transport means in which said devices (12, 12') are mounted.

4. The apparatus (10) according to claim 1 characterized in that each of said devices (12') comprises receiving means (30) for receiving signals coming from devices and sensors installed along a railway path.

5. The apparatus (10) according to claim 1 characterized in that each of said devices (12') comprises memory means (33) for storing data, information and parameters concerning the transport means where said devices (12') are installed.

6. The apparatus (10) according to claim 5 characterized in that said data, information and parameters are stored in an encrypted form.

7. The apparatus (10) according to claim 5 characterized in that said memory means for storing data and parameters are kept in a shock, high temperature, water and dust resistant box in order to preserve the data in any case for future analysis or inspections.

8. The apparatus according to claim 1 characterized in that each of said devices (12') comprises receiving/transmitting means (35) towards wireless networks, and communication terminals (36) intended to be used by travellers, said terminals being directly connected to said receiving/transmitting means communicating through wireless networks.

9. The apparatus according to claim 1 characterized in that said microcomputer control unit (20, 20') performs, through said devices (12, 12'), just as it is powered, a full check of the functionality of the sensors and activating means which are in the vehicle where said devices (12, 12') are installed, and, if anomalies or malfunctioning are detected, a report is sent and the departure of the vehicle is interdicted.

10. A method for monitoring and controlling traffic of public transport means, in particular trains, characterized in that it provides:

mounting, in said transport means, devices (12, 12') configured to receive and transmit data and signals to centralized electronic and computerized units (11) and to directly connect each of the devices (12, 12') to similar devices (12, 12') mounted in other transport means, spreading, in an area where traffic has to be monitored, centralized electronic and computerized units (11) dedicated to control adjacent traffic areas within a predetermined layout and extension, transmitting, by said devices (12, 12'), to said centralized electronic and computerized units (11), identification data pertaining to said transport means where said devices (12, 12') are mounted, and performing, by said centralized electronic and computerized units (11), procedures for processing said data in order to:

define the position of the transport means which are in the monitored area, display in a visualization means (16) a geographical location of the transport means in the monitored area, detect possible anomalous traffic situations with respect to traffic parameters which are stored in said centralized electronic and computerized units (11), send to the devices (12, 12') mounted in the vehicles involved in possible anomalous traffic situations, signals which activate alarm procedures and alarm means, and send to said devices (12, 12'), in case the anomalous traffic situation persists, signals which run breaking means of the vehicles interfaced with said devices.

11. The method for monitoring and controlling traffic of public transport means according to claim 10 characterized in that the position of the transport means which are in the monitored traffic area is determined through a satellite positioning system.

12. The method for monitoring and controlling traffic of public transport means according to claim 10 characterized in that it provides:

direct transmission, at regular intervals, of data and information among devices mounted in vehicles which are within a certain distance range one from the other, automatic starting of alarm procedures in case that anomalous traffic situation are detected, and automatic starting of breaking means of the vehicles in case that said anomalous traffic situations persist.

13. The method for monitoring and controlling traffic of public transport means according to claim 10 characterized in that it provides the automatic starting of alarm procedures comprising breaking means of the vehicles as a result of the transmission of proper signals to the centralized electronic and computerized units (11) from third parties responsible for territory control and civil defence.

14. The method for monitoring and controlling traffic of public transport means according to claim 10 characterized in that the transmission, by said devices (12'), to said centralized electronic and computerized units (11), of identification data pertaining to said transport means where said devices are mounted, is carried out via satellite communication system (21').

* * * * *